US010124936B2

(12) United States Patent
Santarelli et al.

(10) Patent No.: US 10,124,936 B2
(45) Date of Patent: Nov. 13, 2018

(54) CLOSURE WITH LID AND REMOVABLE MEMBRANE

(71) Applicant: AptarGroup, Inc., Crystal Lake, IL (US)

(72) Inventors: Marcelo Santarelli, Buenos Aires (AR); John F. Wagner, Waukesha, WI (US); John M. Wisniewski, Wauwatosa, WI (US); Christopher A. Danks, Waukesha, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/762,351

(22) PCT Filed: May 29, 2013

(86) PCT No.: PCT/US2013/043065
§ 371 (c)(1),
(2) Date: Jul. 21, 2015

(87) PCT Pub. No.: WO2014/193358
PCT Pub. Date: Dec. 4, 2014

(65) Prior Publication Data

US 2015/0353242 A1 Dec. 10, 2015

(51) Int. Cl.
*B65D 43/16* (2006.01)
*B65D 75/58* (2006.01)
(Continued)

(52) U.S. Cl.
CPC ..... *B65D 43/163* (2013.01); *B65D 47/0814* (2013.01); *B65D 47/103* (2013.01);
(Continued)

(58) Field of Classification Search
CPC ..... B65D 5/746; B65D 2251/0093; B65D 2543/00231; B65D 2575/583;
(Continued)

(56) References Cited

U.S. PATENT DOCUMENTS 3,269,617 A 8/1966 Goth
4,568,005 A 2/1986 Jolovec et al.
(Continued)

FOREIGN PATENT DOCUMENTS

JP 2000142769 A 5/2000
WO 2003024775 A1 2/2008

OTHER PUBLICATIONS

The "International Search Report and Written Opinion of the International Searching Authority, or the Declaration" dated Oct. 22, 2013 for the International Application No. PCT/US2013/043065 of which the above-captioned instant U.S. patent application is a U.S. National Phase application.

*Primary Examiner* — James N Smalley
*Assistant Examiner* — Madison L Poos
(74) *Attorney, Agent, or Firm* — Wood, Phillips, Katz, Clark & Mortimer

(57) ABSTRACT

A closure (20, 2GA, 2GB) is provided for a system with an opening. The closure (20, 20A, 20B) has a body (24, 24A, 24B) with an outer end (32, 32B) and a through passage (30, 3GB) for communicating with the system opening. The body (24, 24A, 24B) has a membrane (60, 60B) mitially occluding the through passage (30, 30B). The closure (20, 20A, 20B) has a lid (26, 26A. 26B) to accommodate movement relative to the body (24. 24A, 24B) between a closed position restricting access to the through passage (30, 30B) and an open position permitting greater access to the through passage (30, 30B). The body (24, 24A, 24B) thither has a separation member (70, 7GB) that can be engaged by a user to separate at least a part of the membrane (60, 60B) from
(Continued)

the body (24, 24 A. 24B). The separation member (70, 70B) extends away from the membrane (60, 60B) and has a deployed configuration wherein the separation member (70, 70B) projects outwardly beyond the body outer end (32, 32B) when the lid (26, 26A, 26B) is in the open position. The separation member (70. 70B) further has the capability for assuming a stored configuration with the separation member (70, 70B) engaged by the lid (26, 26A, 26B) with the lid (26, 26A, 26B) in the closed position. Resiliency of the separation member (70, 70B) urges the separation member (70, 70B) ῖιοιη the stored configuration to the deployed configuration when the lid (26, 26A, 26B) is moved from the closed position to the open position.

20 Claims, 17 Drawing Sheets

(51) Int. Cl.
*B65D 47/08* (2006.01)
*B65D 47/36* (2006.01)
*B65D 47/10* (2006.01)

(52) U.S. Cl.
CPC ..... *B65D 47/36* (2013.01); *B65D 75/5883* (2013.01); *B65D 2543/00231* (2013.01); *B65D 2575/583* (2013.01)

(58) Field of Classification Search
CPC ..... B65D 43/163; B65D 47/0814; B65D 47/103; B65D 47/36; B65D 75/5883
USPC ..... 220/270, 789, 791, 793
See application file for complete search history.

(56) References Cited

U.S. PATENT DOCUMENTS

| | | | | |
|---|---|---|---|---|
| 4,757,911 | A | 7/1988 | Larkin et al. | |
| 5,755,360 | A | 5/1998 | Elliott | |
| 6,000,848 | A * | 12/1999 | Massioui | B65D 75/5883 215/306 |
| 6,086,523 | A | 7/2000 | Adams et al. | |
| 7,850,044 | B2 * | 12/2010 | Hildebrand | B65D 75/5883 220/604 |
| 2001/0054616 | A1 * | 12/2001 | Ramsey | B65D 5/749 220/258.2 |
| 2003/0071042 | A1 | 4/2003 | Adams | |
| 2010/0140268 | A1 * | 6/2010 | Lohrman | B65D 47/0838 220/270 |
| 2010/0219186 | A1 * | 9/2010 | Kuwagaki | B65D 47/0838 220/256.1 |
| 2012/0234848 | A1 * | 9/2012 | Muramoto | B65D 5/746 220/789 |

* cited by examiner

CLOSURE WITH LID AND REMOVABLE MEMBRANE

TECHNICAL FIELD

This invention relates to closures for a system.

BACKGROUND OF THE INVENTION AND TECHNICAL PROBLEMS POSED BY THE PRIOR ART

Closures are employed to selectively prevent or permit communication between the exterior and interior of a system (e.g., machine, equipment, containment system (including bottles and pouches), etc.). A typical closure has a body and a lid (e.g., cap or cover). The closure body defines at least one passage through the body for communicating with the system opening and can be either (1) a separate structure for being attached to the system at the system opening, or (2) a structure formed as a unitary portion of the system at the opening.

The lid accommodates movement relative to the closure body passage between (1) a fully closed position occluding the passage, and (2) an open position at least partially exposing the passage.

Various substances (including lotions, creams, food items, granules, liquids, powders, small articles, etc.) may be packaged in a rigid, flexible, or collapsible containment system (e.g., bottle, pouch, portable or stationary equipment, machines or other structures, etc.) having a closure that can be opened and closed. If the containment system is a bottle, pouch, or other such container, then such a container with the closure mounted thereon and the contents stored therein may be characterized as a "package."

A closure for a system may provide an initial hermetic seal and/or may provide an initial tamper-evidency for indicating to a user if the closure integrity has been compromised. One type of such a closure includes a body having a spout defining at least part of the flow passage which is initially sealed closed with a separable membrane. The discharge end of the spout is also covered with a lid that can be removed, or moved away, from the spout so as to "open" the spout and allow access to the separable membrane. Typically, a pull tab or pull ring extends from the membrane. The pull tab or ring projects above the membrane within the spout. The user initially opens the lid, and then grasps the pull tab or ring to pull the membrane so as to separate the membrane from the spout to establish communication between the exterior ambient environment and the interior of the container or other system to which the closure is mounted.

Some spouts may be so small that the user may have difficulty in grasping the pull tab or ring inside the spout. A manufacturer might want to try to overcome this difficulty by extending the pull tab ring outwardly beyond the distal end of the spout. However, the manufacturer might then want to make the closure lid tall enough to accommodate the initially outwardly extending pull tab or ring. Such a design would make the overall package taller and would require more material for manufacturing the taller lid.

The inventors of the present invention have invented a novel structure for a closure for a system wherein the closure includes advantageous features not heretofore taught or contemplated by the prior art.

SUMMARY OF THE INVENTION

According to broad aspects of one form of the present invention, a closure is provided to permit or prevent communication between the exterior and the interior of a system that has an opening between the exterior and interior. The closure includes a body that is either (a) a separate structure for being attached to the system at the opening, or (b) a structure formed as a unitary portion of the system at the opening. The body has at least one outer end and a through passage extending from the outer end through the body. The body further has a membrane that (a) initially occludes the through passage and (b) is initially connected to the rest of the body.

The closure also includes a lid to accommodate movement relative to the closure body between (a) a closed position on the closure body restricting access to the passage and (b) an open position permitting at least greater access to the passage.

The closure body further includes a separation member to be engaged by a user to separate at least part of the membrane from the body. The separation member (1) extends from the membrane, (2) has a deployed configuration wherein the separation member projects outwardly beyond the body outer end when the lid is in the open position, and (3) has the capability for assuming a stored configuration with the separation member engaged by the lid with the lid in the closed position and wherein resiliency of the separation member urges the separation member from the stored configuration to the deployed configuration when the lid is moved from the closed position to the open position.

Numerous other advantages and features of the present invention will become readily apparent from the following detailed description of the invention, from the claims, and from the accompanying drawings.

It should be appreciated that the invention may include any or all of the above-described features, include only one of the above features, more than one of the above features, and any combination of the above features. Furthermore, other objects, features and advantages of the invention will become apparent from a review of the entire specification including any appended claims and drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
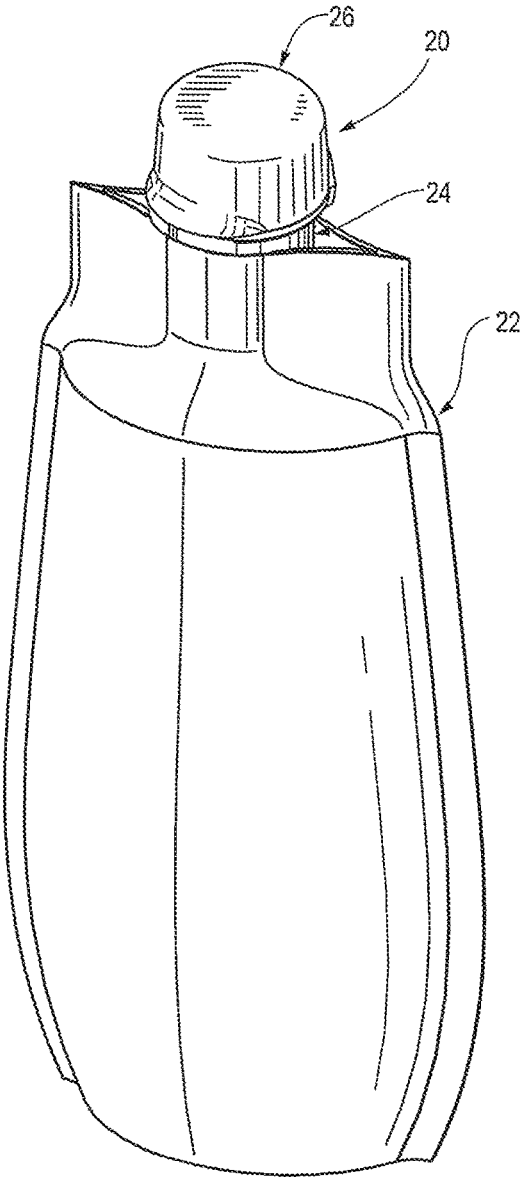
FIG. 1 is an isometric view of a first embodiment of a closure of the present invention shown in a closed condition and installed on a first system in the form of a flexible pouch.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, many figures illustrating the invention show embodiments in the typical orientation that the closure would have at the opening of a system in the form of an upright container, and terms such as upper, lower, horizontal, etc., are used with reference to this orientation. It will be understood, however, that the closure of this invention may be manufactured, stored, transported, used, and sold in an orientation other than the orientations described.

The closure of this invention is suitable for use with a variety of conventional or special systems, the details of which, although not fully illustrated or described, would be apparent to those having skill in the art and an understanding of such systems. The particular systems, per se, that are illustrated and described herein form no part of, and therefore are not intended to limit, the present invention. It will also be understood by those of ordinary skill that novel and non-obvious inventive aspects are embodied in the described exemplary closures alone.

The closure is especially suitable for use on a system that is a containment system that contains a material or substance in the form of a product (e.g., a comestible substance or lotion) that can be dispensed, or otherwise removed, from the system through the opened closure. The product may be, for example, a fluent material such as a liquid, cream, powder, slurry, or paste. If the system is a container, and if the container and closure are large enough, then the product could also be discrete pieces of material (e.g., food products such as nuts, candies, crackers, cookies, etc. or non-food products including various items, particles, granules, etc.) which can be removed through an open closure by hand from a container, or scooped out of a container, or ladled out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

A first embodiment of a closure of the present invention is illustrated in FIGS. 1 and 3-13 wherein the closure is designated generally by reference number 20. In the first illustrated embodiment, the closure 20 is provided in the form of a separate closure which is adapted to be attached to a system in the form of a containment system that would typically contain contents such as a product or products consisting of articles or fluent material.

The system may be a containment system such as a collapsible, flexible pouch, or may be a generally rigid container (which may have somewhat flexible, resilient walls), such as a bottle or tank. FIG. 1 shows a first embodiment of the closure 20 attached to a containment system that is a collapsible, flexible pouch 22. The system may be some other system which may include, or be part of, for example, a medical device, processing machine, dispenser, reservoir on a machine, etc., wherein the system has an opening to the system interior.

Figure 2:
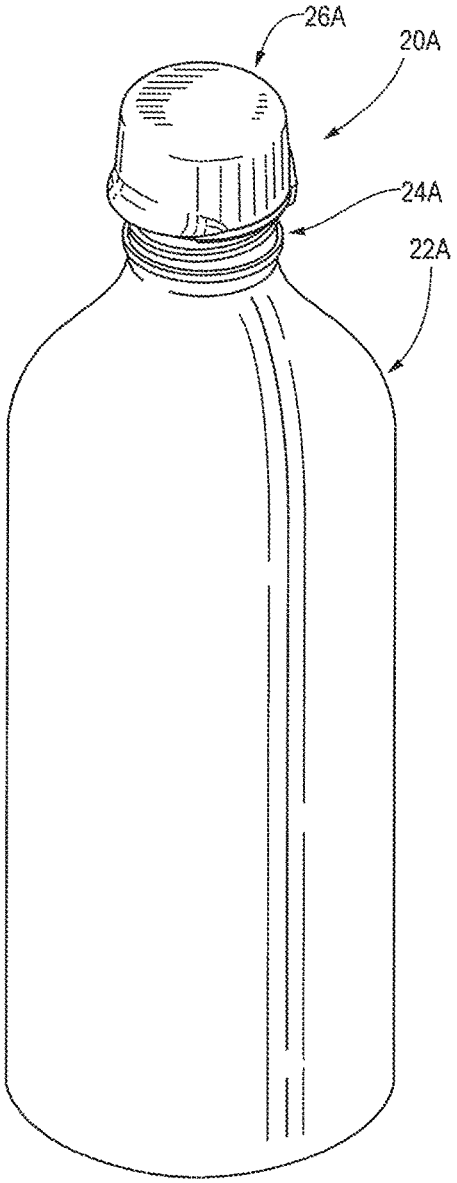
FIG. 2 is an isometric view of a second embodiment of the closure of the present invention shown in a closed condition and installed on a second system in the form of a resilient bottle.

FIG. 2 shows a second embodiment of the closure 20A (discussed in detail below) on a containment system that is a generally rigid container 22A. The second embodiment of the closure 20A is identical to the first embodiment of the closure 20, except that the second embodiment of the closure 20A has a closure body base (not visible in FIG. 2) that has been adapted for engagement with the generally rigid container 22A (as will be discussed in detail below) and that is generally known to one of ordinary skill in the art of closure design and manufacturing.

If the system is a containment system such as a container, then the containment system, or a portion thereof, may be made from a material suitable for the intended application (e.g., a thin, flexible material for a pouch wherein such a material could be a polyethylene terephthalate (PET) film or a polyethylene film and/or an aluminum foil, or a thicker, less flexible material such as molded polyethylene or polypropylene for a more rigid container such as a bottle).

In applications wherein the closure is mounted to a container such as a bottle or pouch, it is contemplated that typically, after the closure manufacturer makes the closure (e.g., by molding the closure 20 or 20A from a thermoplastic polymer), the closure manufacturer will then ship the closure to a container filler facility at another location where the container is either manufactured or otherwise provided, and where the container is filled with a product. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the illustrated embodiments, the closure 20 or 20A (as well as a third embodiment of the closure 20B described hereinafter) is provided as a separately manufactured article, component, or unit for being non-removably attached (e.g., mounted or installed) on a system in the form of a containment system defined by a pouch or bottle. It will be appreciated, however, that in some applications (not illustrated), it may be desirable for the closure to be attached to a system in a manner that would allow a user to remove the closure from the system. Further, it may be desirable for the closure for at least the body of the closure) to be formed as a unitary part, or extension, of the system (e.g., a bottle) wherein such a unitary part or extension also (i.e., simultaneously) defines an end structure of the system, per se.

The illustrated embodiments of the closure, if initially formed separately from the containment system, are adapted to be attached to a containment system at an opening which provides access to the container interior and to the contents (e.g., a product contained therein) after a portion of the closure is opened as described hereinafter.

The system, per se, such as a bottle, pouch, or other containment system, per se, does not form a part of the broadest aspects of the present invention, per se. The containment system, or other system, may have any suitable configuration.

Where the system is a bottle, the bottle typically includes an upper end portion or other suitable structure on some part of the bottle that defines the bottle mouth or opening, and such a bottle upper end portion typically has a cross-sectional configuration with which the closure (e.g., closure 20A in FIG. 2) is adapted to engage. The main body portion of the bottle may have another cross-sectional configuration that differs from the cross-sectional configuration of the bottle upper end portion at the bottle opening. On the other hand, the bottle may instead have a substantially uniform shape along its entire length or height without any portion of reduced size or different cross-section. The bottle may have a generally rigid, or somewhat flexible, wall or walls which can be grasped by the user.

The particular embodiment of the closure 20A illustrated in the FIG. 2 is especially suitable for use with a container that is a bottle having a substantially flexible wall or walls that can be squeezed or deflected laterally inwardly by the user to increase the internal pressure within the container so as to force the product out of the container and through the opened closure. In a bottle with a flexible wall or walls, such a flexible wall or walls typically have sufficient, inherent resiliency so that when the squeezing forces are removed, the container walls return to the normal, unstressed shape.

In other applications it may be desirable to employ a generally rigid container, and to pressurize the container interior at selected times with a piston or other pressurizing system, or to reduce the exterior ambient pressure so as to suck the material out through the open closure.

On the other hand, if the closure has a suitably large access passage or aperture that can be opened to communicate with the containment system interior, then such a closure can be used on a rigid container from which the contents (e.g., the product) can be accessed through the opened closure and removed by pouring out the contents, or by scooping out the contents, or by withdrawing the contents by hand or with an instrument, etc.

In other applications, contents can be added through the opened closure to the containment system.

In still other applications for use with a system which may be a product containment system or other type of system, the closure can function to permit or prevent the egress or ingress of ambient atmosphere, or other substances, relative to the system in which the closure is installed.

Figure 3:
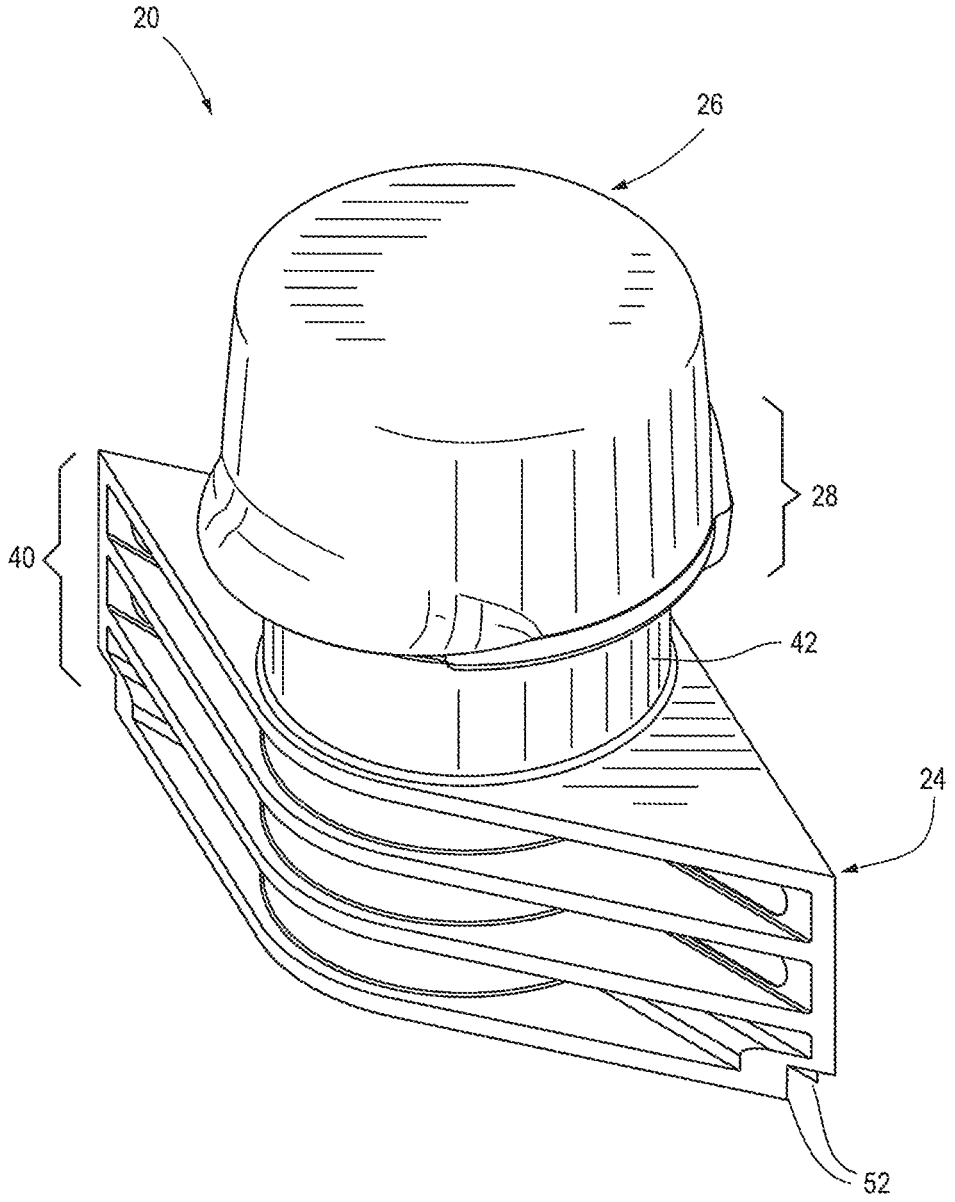
FIG. 3 is an isometric view of the closed closure shown in FIG. 1, but FIG. 3 shows the closure alone with the lid closed prior to the closure being installed on the flexible pouch.
Figure 4:
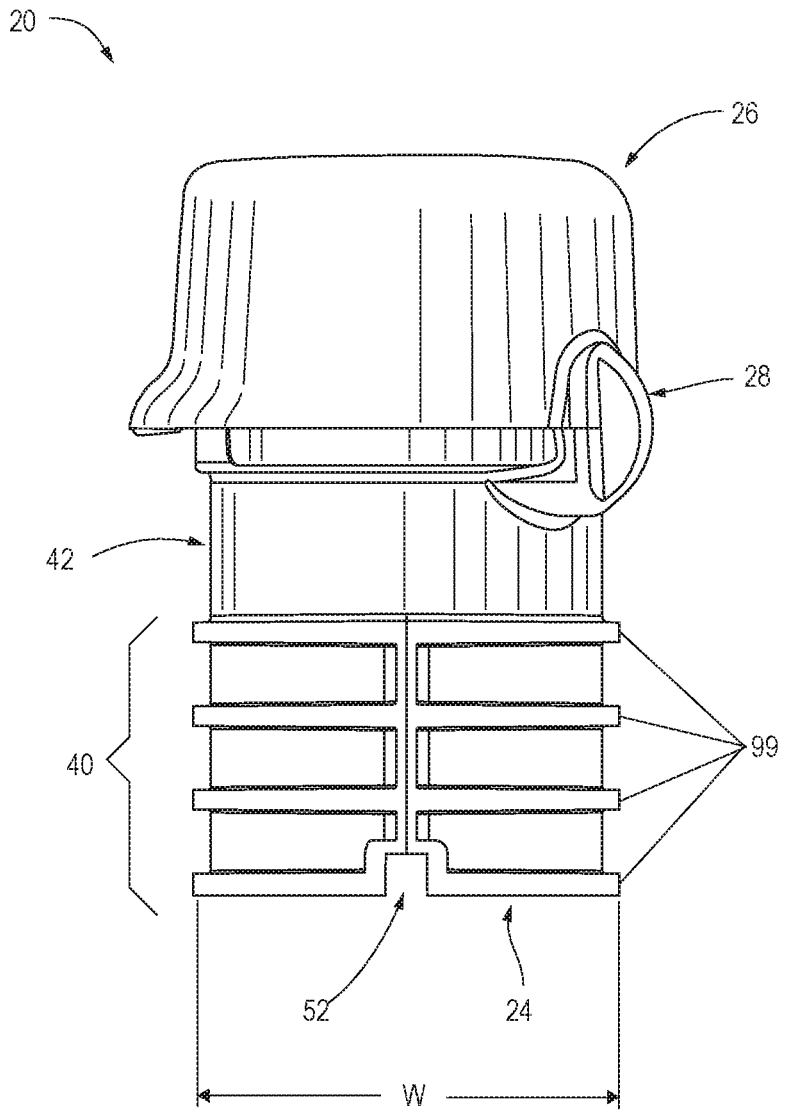
FIG. 4 is a side elevational view of the closed closure shown in FIG. 3.
Figure 5:
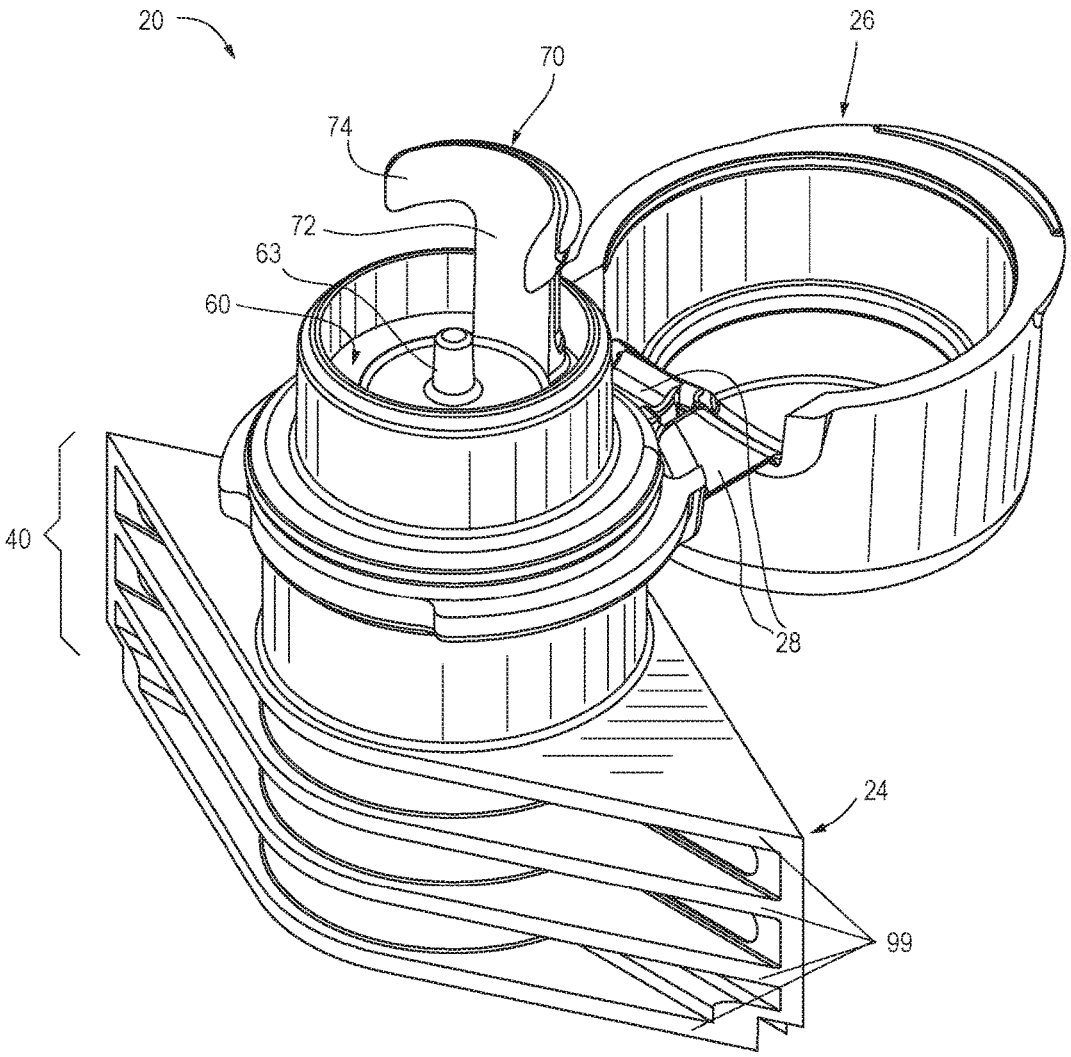
FIG. 5 is an isometric view of the closure shown in FIG. 1, but FIG. 5 shows the closure alone with the lid open in the as-molded condition prior to the lid being closed and the closure installed on the flexible pouch.

In the first embodiment illustrated in FIGS. 1 and 3-13, the closure 20 includes a closure body 24, a lid 26, and a connecting structure in the form of a hinge 28 which connects the body 24 and lid 26 (as best shown in FIGS. 3, 4, and 5). The closure body 24, lid 26, and hinge 28 are preferably molded as a unitary structure from a suitable thermoplastic material such as polyethylene, polypropylene, or the like. In a presently preferred form of the closure 20, the body 24, lid 26, and hinge 28 are molded together as a unitary structure from linear low density polyethylene (LLDPE). Other materials may be employed instead.

The hinge 28 may be of any suitable type. One form of a hinge that may be used is the over-center, snap-action type hinge. Other types of hinges could be used. In some applications, the hinge could be omitted altogether, and the lid need not be connected as a unitary part of the closure body. In alternative embodiments (not illustrated), the lid 26 may be a separate component adapted to be mounted to, and completely removed from, the closure body 22, or the lid 26 may be tethered to the closure body 24 with a strap.

Figure 10:
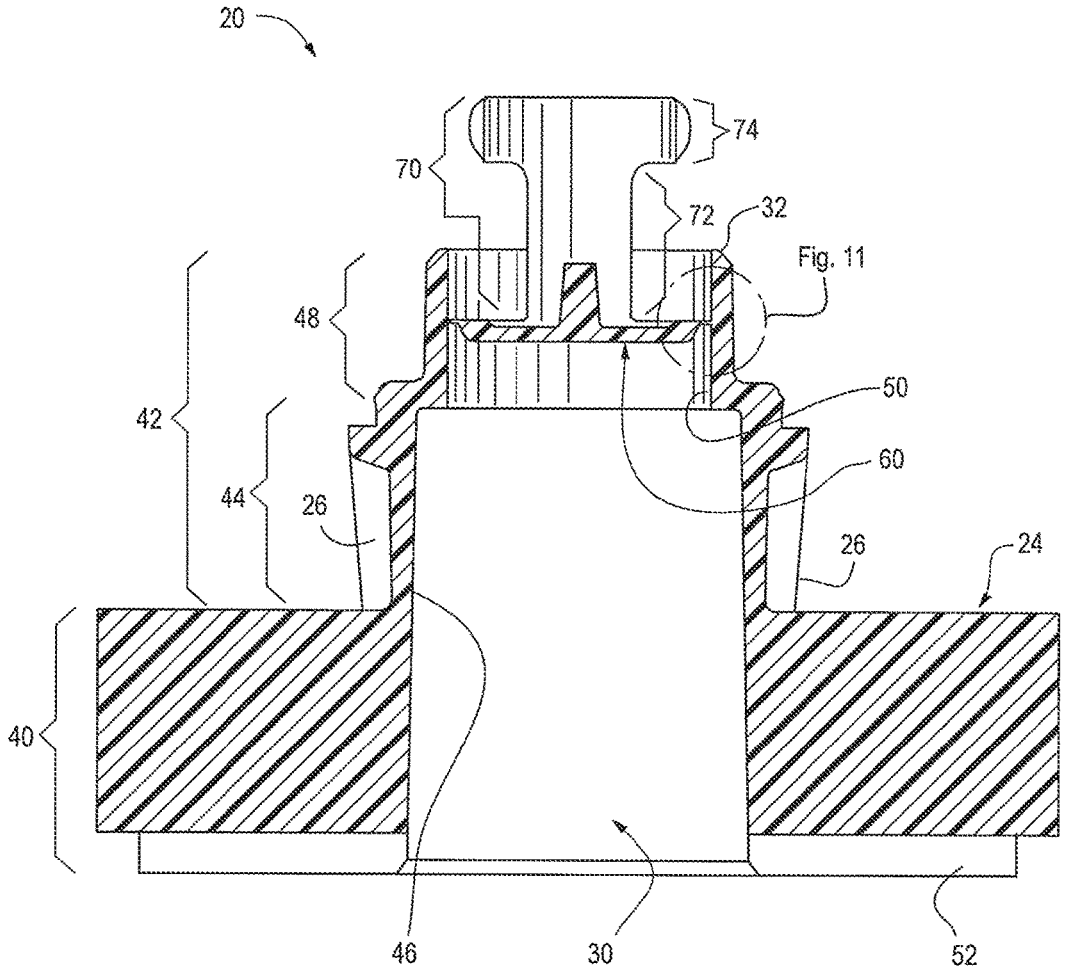
FIG. 10 is a cross-sectional view of open lid closure shown in FIG. 7 taken generally along the plane 10-10 in FIG. 7.

In the illustrated first embodiment of the closure 20, the lid 26 accommodates movement relative to the body 24 between (a) a closed position on the body (as shown in FIGS. 3 and 4) and (b) an open position (FIG. 5) which, as shown in FIG. 10, permits greater access to a through passage 30 in the body 24.

The closure 20 is molded by the manufacturer with the lid 26 in an open position. Then the manufacturer moves the lid 26 to the closed position. The closed closure 20 would typically then be shipped to a pouch manufacturer, and the pouch manufacturer would install the closure 20 on the pouch 22. The pouch 22 may have already been filled with product, or the closure 20 may be installed on an empty pouch 22 that is subsequently filled with product through an open bottom end of the pouch 22 which is thereafter sealed closed.

It is presently contemplated that most pouch manufacturers will prefer to install the closure 20 on the pouch 22 with heat sealing techniques or ultrasonic sealing techniques (and most bottlers would prefer to install the second embodiment of the closure 20A, as shown in FIG. 2, on a bottle 22A with the closure 20A suitably configured for snap-fit attachment or threaded attachment as explained below). In an alternate installation process, the closure 20 or 20A could be installed on the containment system (e.g., pouch 22 or bottle 22A, respectively) with adhesive.

The second embodiment of the closure 22A could have a body 24A with various configurations and attachment features (not visible in FIG. 2) that are particularly useful for a container having semi-rigid, resilient walls, or having rigid walls. For example, the closure body 24A could have a cylindrical portion with a thread for threadingly engaging a mating thread of the container 22A (FIG. 2). Alternatively, the closure 20A and container 22A could be provided with a suitable snap-fit engagement that would resist removal of the closure 20A by a user of the package.

Further, other means of providing a generally non-removable or removable attachment of the closure 20 or 20A to the container are contemplated. These means could include the use of a suitable mechanical lock system, spin welding of the closure to the container, etc.

Figure 7:
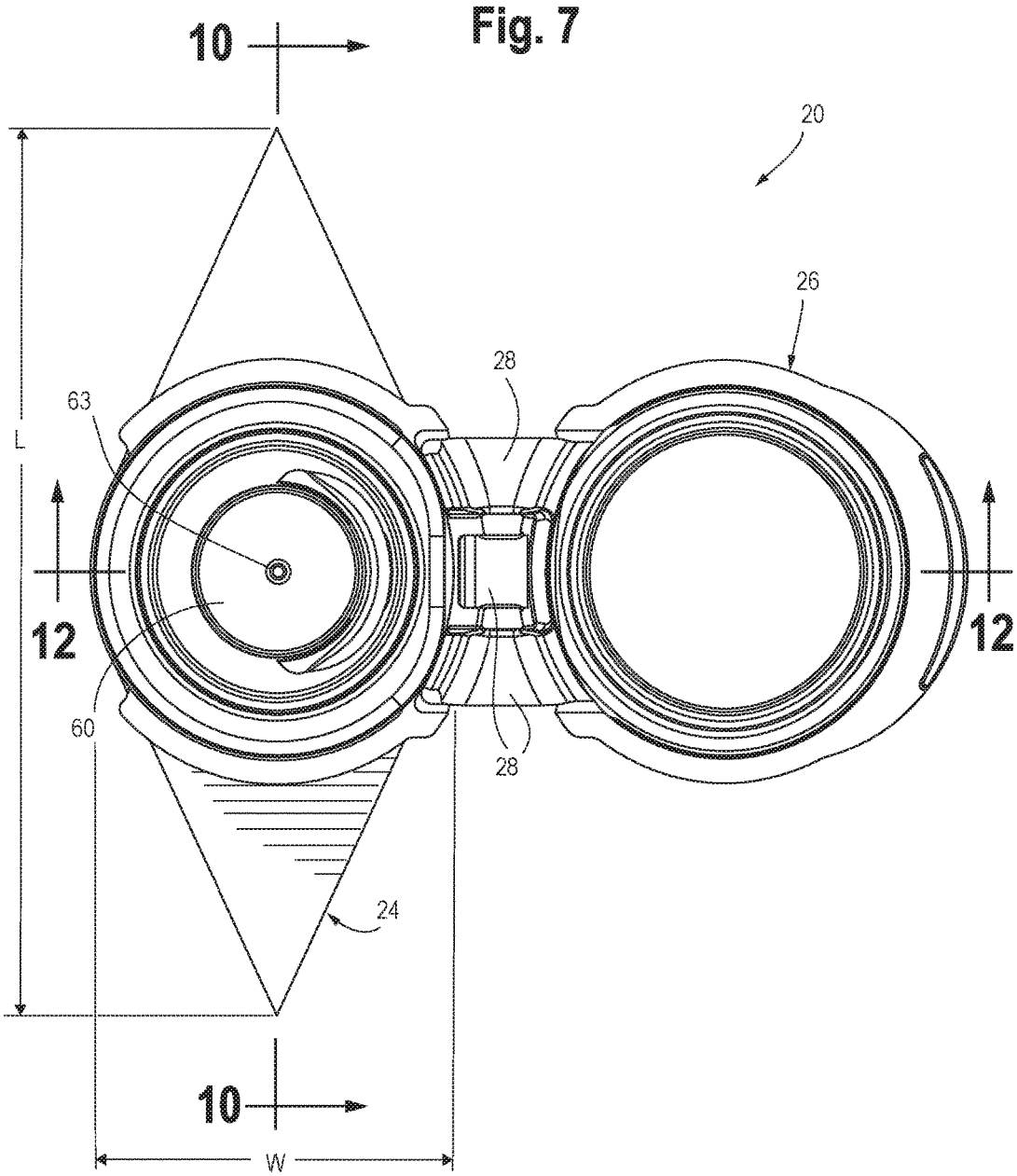
FIG. 7 is a top plan view of the closure shown in FIG. 5 with lid opened and the membrane initially sealing closed the closure body.
Figure 8:
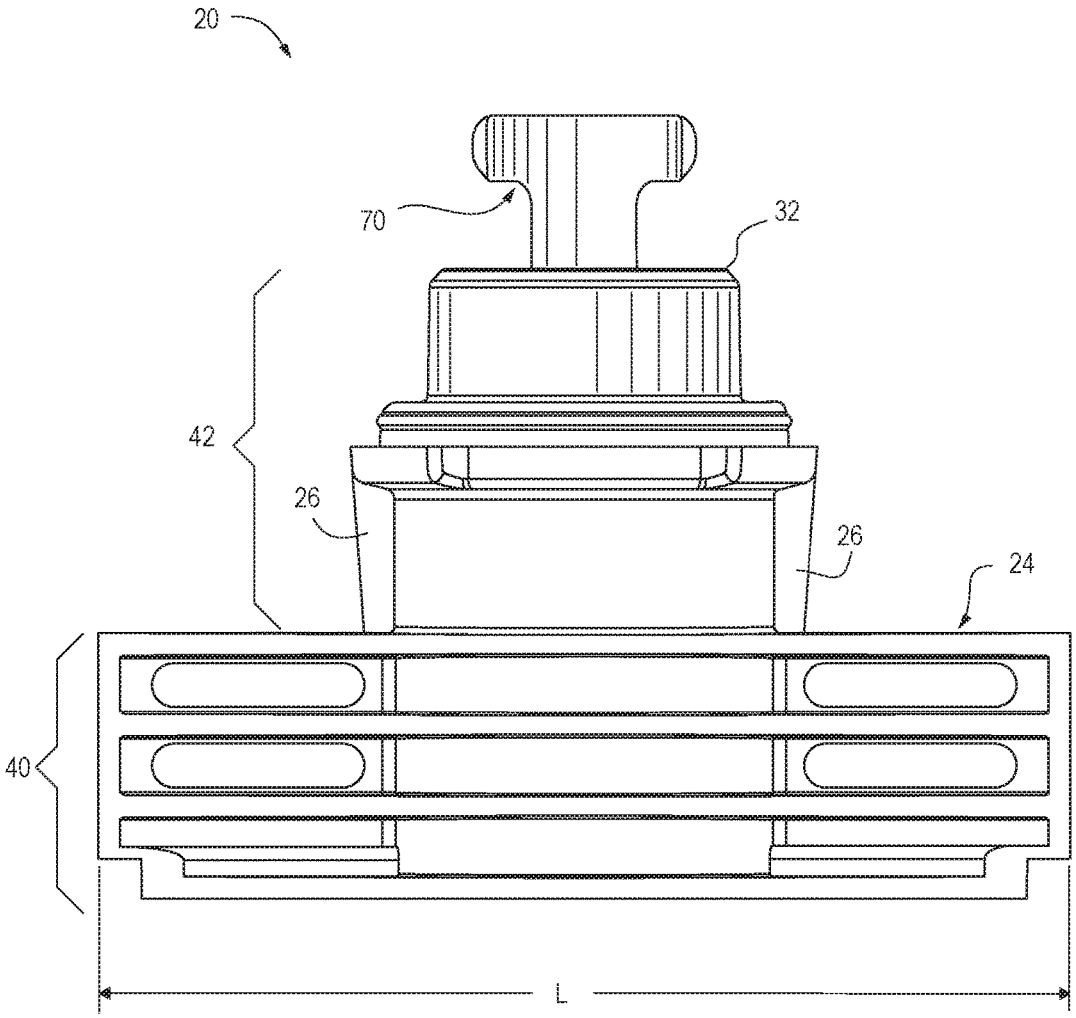
FIG. 8 is a front elevational view of the open lid closure shown in FIG. 5.

The first illustrated embodiment of the closure 20 has a closure body 24 with an initially occluded through passage 30 and outer end 32 as best seen in FIG. 10, which is a cross-sectional view taken generally along plane 10-10 in FIG. 7. The through passage 30 extends from the outer end 32 through the body 24. The through passage 30 (when opened as described hereinafter) communicates with an opening of the containment system or pouch 22 to permit removal of the contents from the interior of the pouch 22, or the addition or refilling of a substance into the pouch 22, or the ingress or egress of other substances.

Figure 13:
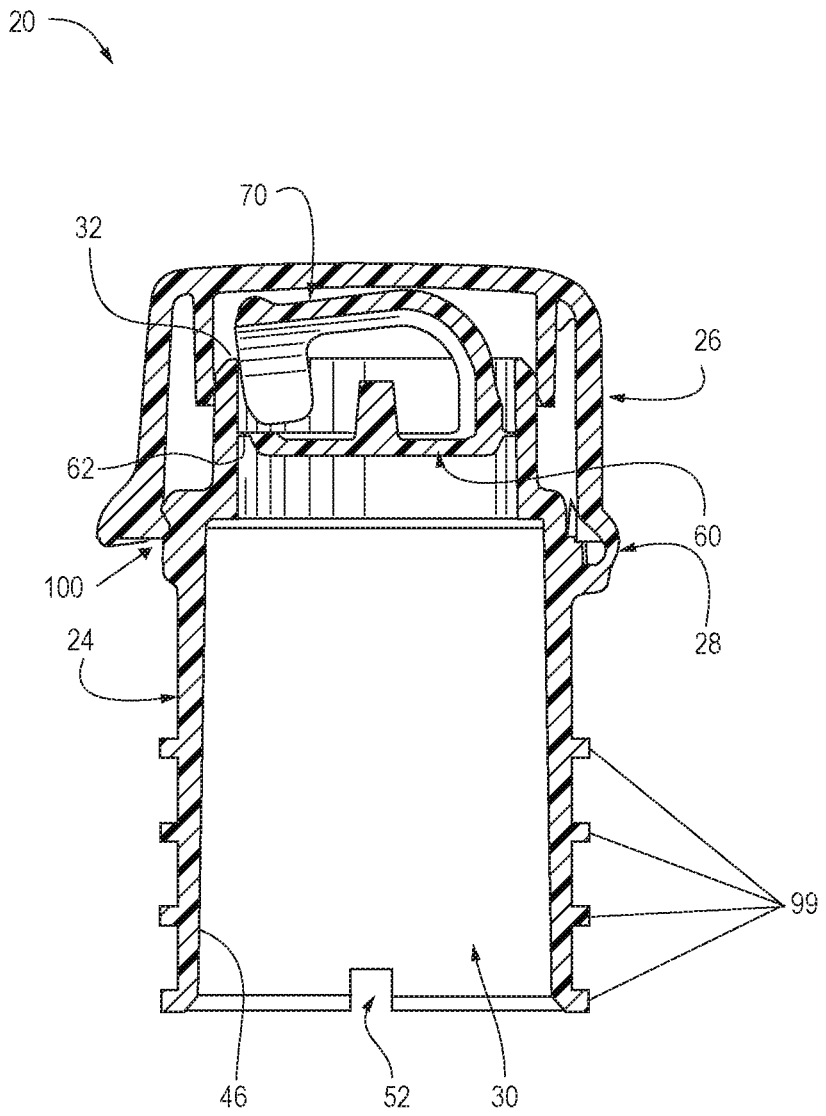
FIG. 13 is a cross-sectional view that is similar to the view in FIG. 12, but with the lid of the closure shown in the closed position.

As can best be seen in FIG. 10, the closure body 24 preferably includes a base 40 from which a spout 42 projects outwardly. The through passage 30 extends through both the base 40 and the spout 42. It will be appreciated that the closure body 24 may take a variety of forms, and need not have a discernible spout or base at all. Further, it is understood that the through passage 30 and spout 42 need not have circular cross-sections as shown. The interior of the through passage 30 and/or spout 42 may be elliptical, a polygonal, or some irregular shape. In the first illustrated embodiment of the closure 20, the closure base 40 of the body 24 has the form of a generally diamond-like or boat-shaped fitment when viewed in plan from above with a length ("L" in FIG. 8) and a width (W in FIG. 4), the length "L" being greater than the width "W". The closure body 24 is further provided with a plurality of sealing surfaces or ribs 99 (FIGS. 4 and 5) for being sealed to an opening of a flexible pouch 22 (FIG. 1) which are spaced apart in the longitudinal, vertical direction. As can be seen in FIG. 13, the body 24 and the lid 26 include cooperating, mating latch features 100 for retaining the lid 26 together with the body 24 in a closed position.

As best shown in FIG. 10, the first illustrated embodiment of the closure 20 has a spout 42 that includes a lower portion 44 having a lower interior surface 46 defined by a first circumference of the through passage 30. The spout 42 further includes an upper portion 48 having an upper interior surface 50 defined by a second (smaller) circumference of the through passage 30 (FIG. 10). It will be further appreciated that the first circumference of the through passage 30 need not be greater than the second circumference of the through passage 30.

Figure 9:
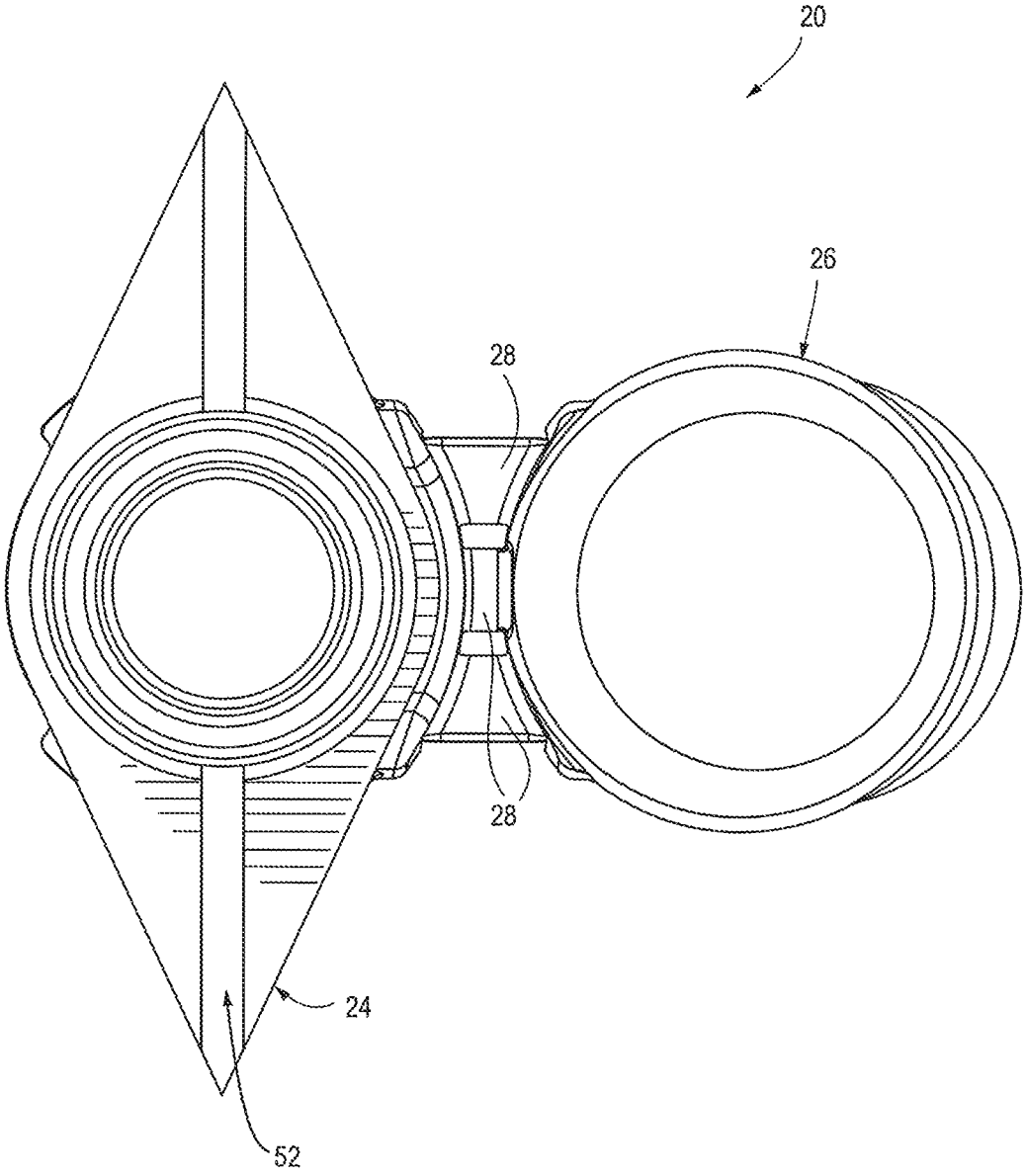
FIG. 9 is a bottom view of the open lid closure shown in FIG. 5.
Figure 12:
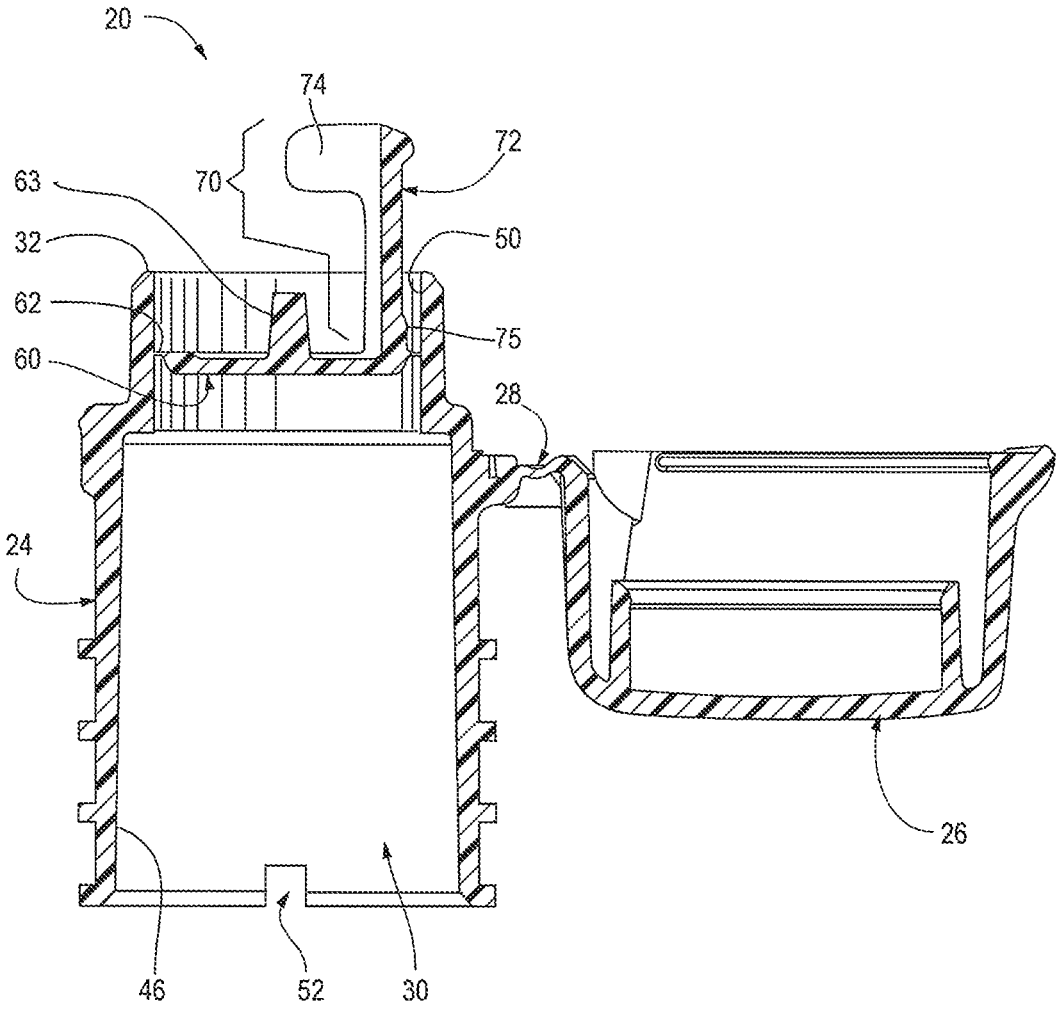
FIG. 12 is a cross-sectional view of the open lid closure shown in FIG. 7 taken generally along the plane 12-12 in FIG. 7.

As can best be seen in FIGS. 3, 9, and 12, the closure body 24 may further have an optional alignment feature 52 for aligning the body 24 relative to the containment system or pouch 22 during installation of the closure 20 with the pouch 22. The alignment feature 52 is designed to interface with a mating alignment portion the installation system (not illustrated) which may be of a suitable conventional or special design. While the alignment feature 52 is shown as a square slot running through the closure body 24 in the preferred embodiment, the alignment feature 52 may instead have a variety of geometries such as a rounded slot or polygonal slot. Further, the alignment feature may be provided such that that it does not run through the entire length "L" of the closure body, and may be one or more discrete recesses within the closure body (not illustrated). The alignment feature 52 need not be provided on a particular surface of the closure body.

In the past, with situations involving a package that includes a closure on a pouch, it has been found that if the closure body is subjected to a torque relative to the pouch, then there is an increased risk that the lower portion of the closure body can puncture the pouch. The alignment feature 52 illustrated in FIGS. 3, 9, and 12 can reduce the risk of the closure body 24 puncturing the pouch 22. The alignment feature 52 described above can function to define a chamfer or cut away to minimize the likelihood that the bottom corner of the body 24 would puncture the pouch 22 upon the application of a torque to the closure body 24.

The closure body 24 has a membrane 60 as best seen in FIGS. 5 and 10. The membrane 60 is initially connected to the closure body 24 to initially occlude the through passage 30 (FIG. 10). The membrane 60 is connected to the rest of the closure body 24 at the upper interior surface 50 of the upper portion 48 of the spout 42 (as best seen in FIG. 10). However, it will be understood that the membrane 60 may alternatively be connected to the closure body 24 at the lower interior surface 46 of the lower portion 44 of the spout 42. The membrane also may alternatively be provided in the base 40 of the closure body 24 to occlude the through passage 30.

Figure 11:
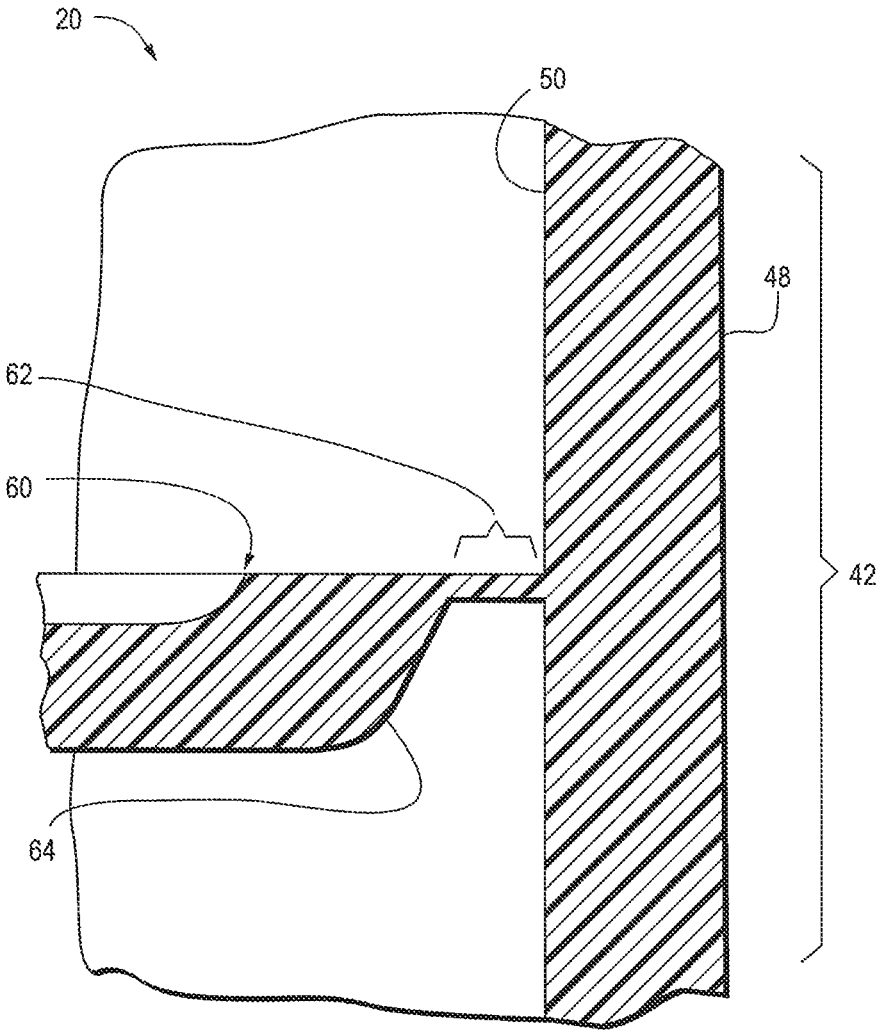
FIG. 11 is a greatly enlarged, partial cross-sectional view of the area within the circle labeled FIG. 11 in FIG. 10.

The membrane 60 includes a peripheral portion 62 that connects to the spout upper interior surface 50 (FIG. 11). In the presently preferred form of the first embodiment of the closure 20 illustrated in FIGS. 1 and 3-13, the peripheral portion 62 is a weakened area or region. The illustrated preferred form of the weakened area is a region of reduced cross-sectional thickness compared to a laterally inward portion of the membrane 60 (as best seen in FIG. 11). When a user of the closure 20 separates the membrane 60 from the closure body 24 (as discussed below), the weakened area permits the user to employ a lower force to remove the membrane 60 from the body 24. After the user has separated the membrane 60 from the closure body 24, there may be a small remnant (not illustrated) of the peripheral portion 62 that remains attached to the body 24 while most of the membrane 60 remains intact and separate from the closure body 24. Further, other means of providing a peripheral portion 62 with a weakened area are contemplated. These means could include the use of material weakening by residual internal stress, subjecting the peripheral portion 62 to dynamic stress, die cutting, etching, or chemical treating of the peripheral portion 62 to create the weakened area.

In the preferred arrangement as best illustrated in FIGS. 5, 10, and 12, the membrane 60 has an injection boss 63 extending outwardly from the membrane 60 at a generally central location. The injection boss 63 defines the region at which the polymer resin is injected into the mold. The central location of the injection boss 63 reduces the chance for uneven filling of the peripheral portion 62 of the membrane 60 during the injection molding of the closure 20. Uneven filling could result in voids or pinholes in the thin peripheral portion 62. Placing the injection boss 63 at or near the center of the membrane 60 accommodates symmetric plastic flow from the boss 63 into the rest of the membrane 60 and through the peripheral portion 62 into the closure body 24. However, it will be understood that in the broadest concept of the present invention, the membrane 60 need not have an injection boss 63 located in the center of the membrane 60, or need not even have any injection boss 63.

Laterally inwardly of the peripheral portion 62, the thickness of the membrane 60 increases. In the preferred arrangement illustrated in FIG. 11, the membrane 60 has a surface 64 that slopes away from the peripheral portion 62 and toward the system interior. This arrangement aids in focusing stress to the peripheral portion 62 to enable a user to separate the membrane 60 more easily from the closure body 24. It will be appreciated that in the broadest concept of the present invention, the membrane 60 need not have a surface 64 extending inwardly toward the system interior. For example, in some applications, the bottom surfaces (i.e., interior surfaces) of the peripheral portion 62 and of the rest of the membrane 60 could be co-planar, and the increased thickness of the membrane 60 could instead project upwardly (i.e., outwardly) higher than the peripheral portion 62.

Figure 6:
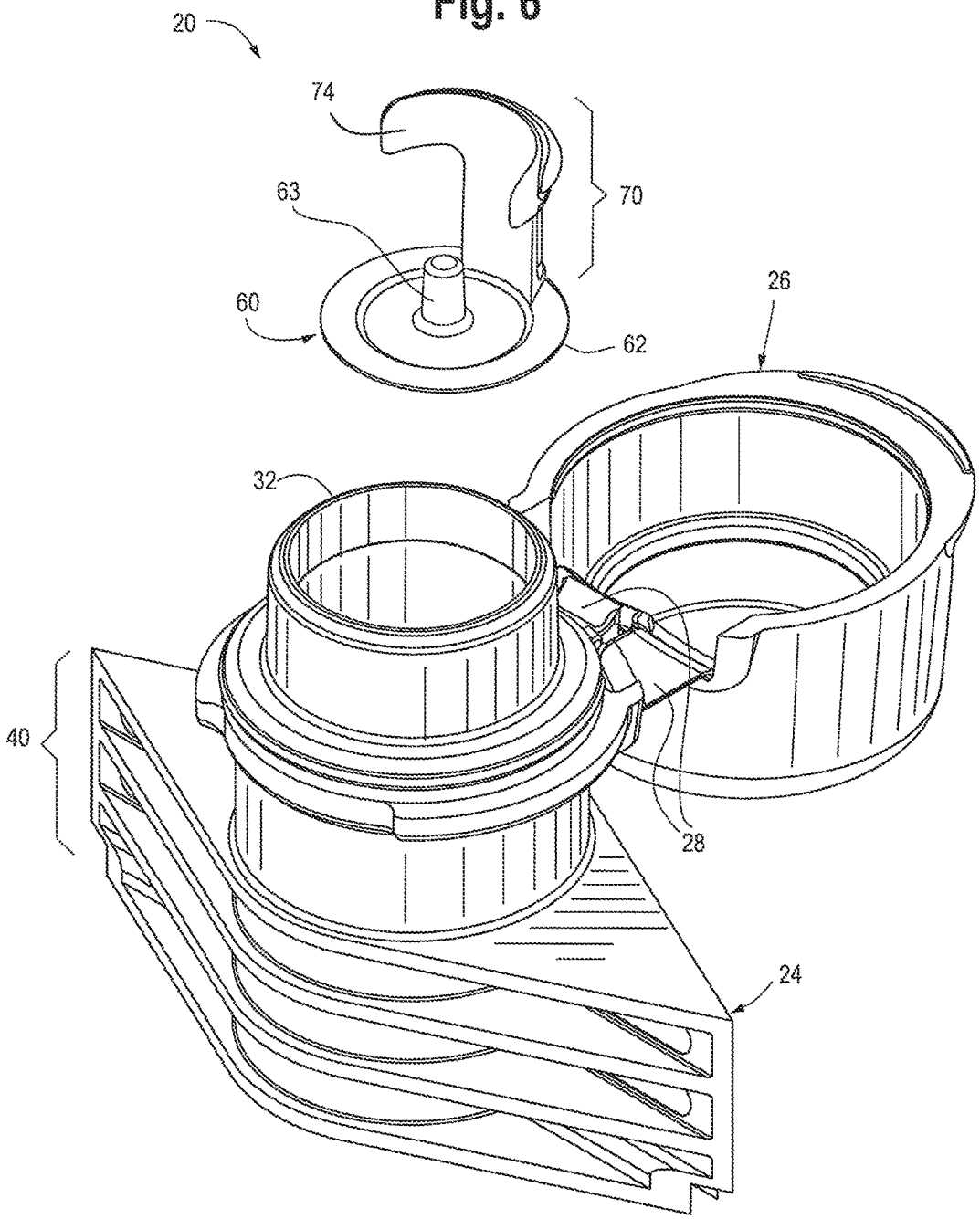
FIG. 6 is an exploded, isometric view of the closure shown in FIG. 5 after a user has opened the closure lid and removed the membrane from the closure body.

The first illustrated embodiment of the closure 20 has a separation member 70 (FIGS. 5 and 10) extending from the membrane 60. The separation member 70 is designed for engagement by a user to separate at least a part of the membrane 60 from the closure body 24 (as shown in FIG. 6) as explained hereinafter. Complete or partial removal of the membrane 60 would indicate to a subsequent user that at least a portion of the closure has been breached. Thus, the closure can function as a tamper-evident closure.

The separation member 70 has a deployed configuration where the separation member 70 projects outwardly beyond the body outer end 32 when the lid 26 is in the open position (as shown in FIGS. 10 and 12). The separation member 70 further has the capability for assuming a stored configuration with the separation member 70 engaged by the lid 26 when the lid 26 is in the closed position (as shown in FIG. 13). Resiliency of the separation member 70 urges the separation member 70 from the stored configuration to the deployed configuration when the lid 26 is moved from the closed position to the open position (as shown in FIG. 12).

The closure 20 is initially molded with the lid 26 open and the separation member 70 in an outwardly projecting "as-molded" configuration. Then the lid 26 is closed to engage the top of the separation member 70 and force it into the stored configuration (FIG. 13). The closure 24 with the lid 26 closed can then be installed on a system, such as, for example, the pouch 22 (FIG. 1). Subsequently, a user can open the lid 26 to expose the separation member 70 so that the inherent resiliency of the separation member 70 causes the member 70 to move from the stored configuration to the deployed configuration.

When the lid 26 is returned to the open position, the separation member 70 may return either partially or fully to the deployed configuration. The deployed configuration may or may not be exactly the same as the initially as-molded configuration of the separation member 70—depending on whether the molded material has taken on some amount of "set" or permanent (inelastic) deformation. In the stored configuration, the separation member 70 has at least some elastic deformation. The behavior of the separation member 70 may be selectively tuned by the choice of material, amount of deformation in the stored configuration, the length of time of deformation in the stored configuration, environmental factors, and even the use of an optional design that would accommodate a pulling force interaction with an optional catch structure on the lid 26 (not shown).

The separation member 70, in the first illustrated embodiment of the closure 20 as best seen in FIG. 10, includes a stem 72 extending outwardly from the membrane 60. The separation member 70 further includes a grippable portion 74 that extends laterally from the stem 72 (FIG. 6). In the first embodiment of the closure illustrated in the FIG. 5, the bottom end or base of the stem 72 has an arcuate curvature along the membrane 60. However, it will be appreciated that the stem 72 may be provided in a variety of configurations and extend from the membrane 60 in a variety of configurations.

By providing the separation member 70 in the form of a stem 72 and a grippable portion 74, a user may grip and remove the membrane 60 more easily, it will be understood, however, that in the broadest concept of the present invention, the separation member 70 need not have a discernible stem 72 or grippable portion 74. The separation member 70 may be of any suitable geometry that will allow a user to separate the membrane 60 from the closure body 24 by gripping the separation member 70 between user's thumb and finger, or by gripping or hooking it with a tool.

As can best be seen in FIG. 12, the radially outwardly facing side of the stem 72 bulges out at the bottom to define bulging bottom end 75 that has an increased thickness at the membrane 60 adjacent the peripheral portion 62. This increased thickness aids in focusing stress in the peripheral portion 62 to enable a user to separate the membrane 60 more easily from the closure body 24. It will be appreciated that in the broadest concept of the present invention, the stem 72 need not have an increased thickness at the membrane 60, and in some applications may have no change in thickness, or may even have a decreased thickness at the membrane 60.

The first illustrated embodiment of the closure 20 has a grippable portion 74 with an arcuate configuration (as shown in FIG. 5), and more specifically the grippable portion 74 extends in an arcuate configuration a central angle of less than, or equal to, 180 degrees (as shown in FIG. 7) with respect to the center of the membrane 60 such that the grippable portion 74 remains on one side of the closure body length "L". It will be appreciated that the grippable portion 74 may be provided in a variety of forms such as an arc that is not symmetric with respect to the stem 72, or an arc with a greater or shorter length, or an arc of greater or lesser thickness than shown in FIG. 5. Moreover, the grippable portion 74 may take the form of another shape that is not an arc, such as a ring, polygon, or other suitable projecting member to be engaged by a user of the closure.

The grippable portion 74, which is in the form of an arc in the first embodiment illustrated in FIG. 5, has advantages—such as accommodating a reduced height of the stored configuration of the separation member 70 and accommodating a reduced loading force on the separation member 70 in the stored configuration. Also, regardless of the shape of the grippable portion 74, the capability of the separation member 70 to assume the stored configuration (FIG. 13), permits the manufacturer to employ a readily grippable tall stem 72 in the deployed configuration even though the lid 26 can be made shorter. This decrease in height of the lid 26 saves on material and reduces the overall size of the closure 20.

The second embodiment of the closure 20A shown on the containment system or bottle 22A in FIG. 2 has a lid 26A connected to a body 24A. The base of the body 24A is configured to be mounted in the neck of the container 22A. The upper part of the base 24A and overlying lid 26A have the same configuration as, and function in the same manner as, the corresponding structures in the first embodiment of the closure 20 described above with reference to FIGS. 1 and 3-13.

A third embodiment of the closure 20B is illustrated in FIGS. 14-18 and is generally similar to the first embodiment of the closure 20 discussed above with reference to FIGS. 1 and 3-13. It will be understood that the third embodiment is not limited to any particular system, and may be modified for incorporation in various systems, including the containment system 22A (shown in FIG. 2) that is a generally rigid bottle.

The closure 20B is similar, and functions in a similar manner, to the first embodiment of the closure 20 described above with reference to FIGS. 1 and 3-13. The elements of the third embodiment of the closure 20B that are identical or functionally analogous to those of the first embodiment of the closure 20 are designated by reference numerals identical with those used for the first embodiment with the exception that the third embodiment reference numerals are followed by the upper case letter B whereas the first embodiment reference numerals are not followed by any letter.

The third embodiment of the closure 20B includes a body 24B, lid 26B, and hinge 28B. The body 24B includes (1) a base 40B with an alignment feature or slot 52B, and (2) a spout 42B with an outer end 32B. A through passage 30B extends through the body 24B from the outer end 32B. The body 24B includes a membrane 60B attached across the passage 30B with a peripheral portion 62B. An injection boss 63B and separation member 70B project upwardly from the membrane 60B. The separation member 70B includes a stem 72B and grippable portion 74B.

Figure 16:
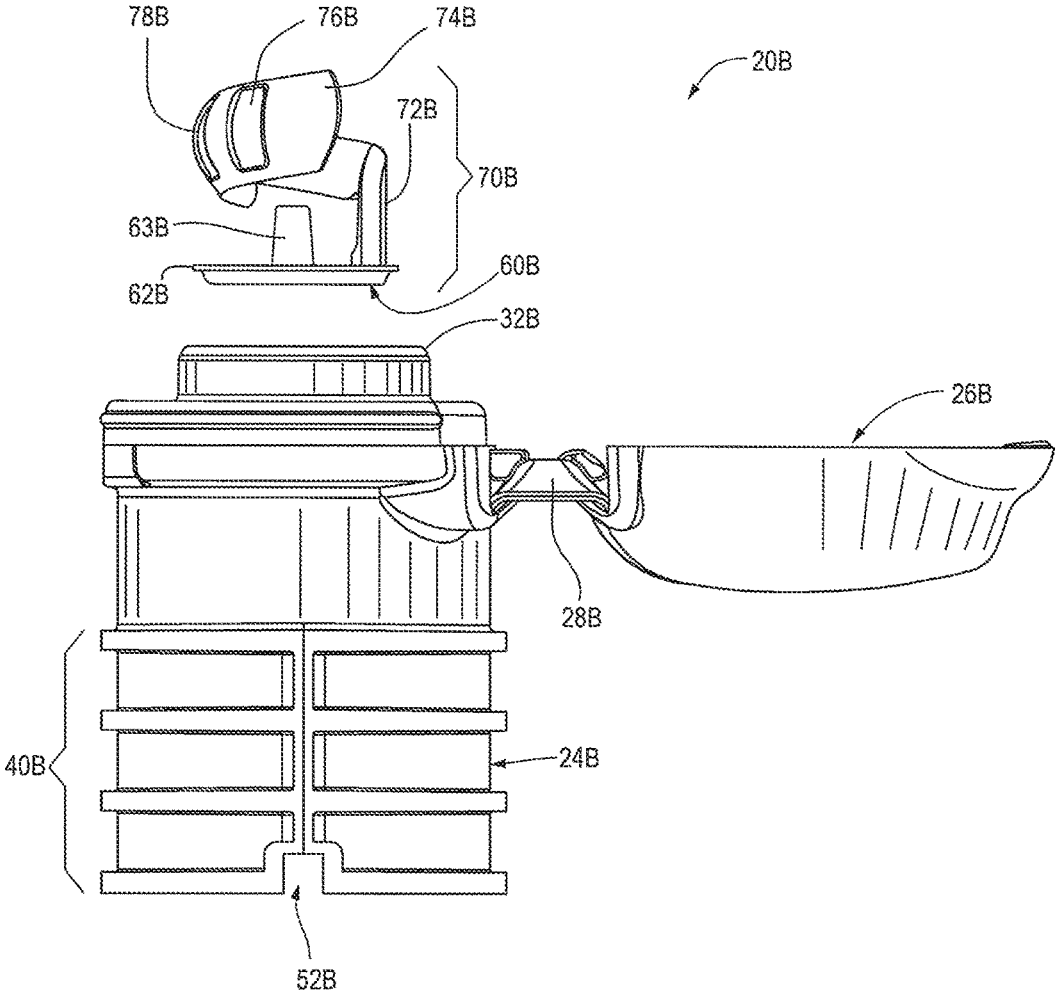
FIG. 16 is a side elevational view of the closure shown in FIG. 14, but FIG. 16 shows the membrane removed from the closure body.

The third embodiment of the closure 20B differs primarily from the first embodiment of the closure 20 in that the third embodiment of the closure 20B has a different structure for the grippable portion 74B of the separation member 70B (FIG. 16). The different structure of the grippable portion 74B can provide certain desirable features and facilitate manufacturing. In other respects, the third embodiment of the closure 20B functions in the same manner as the first embodiment of the closure 20 discussed above.

Figure 14:
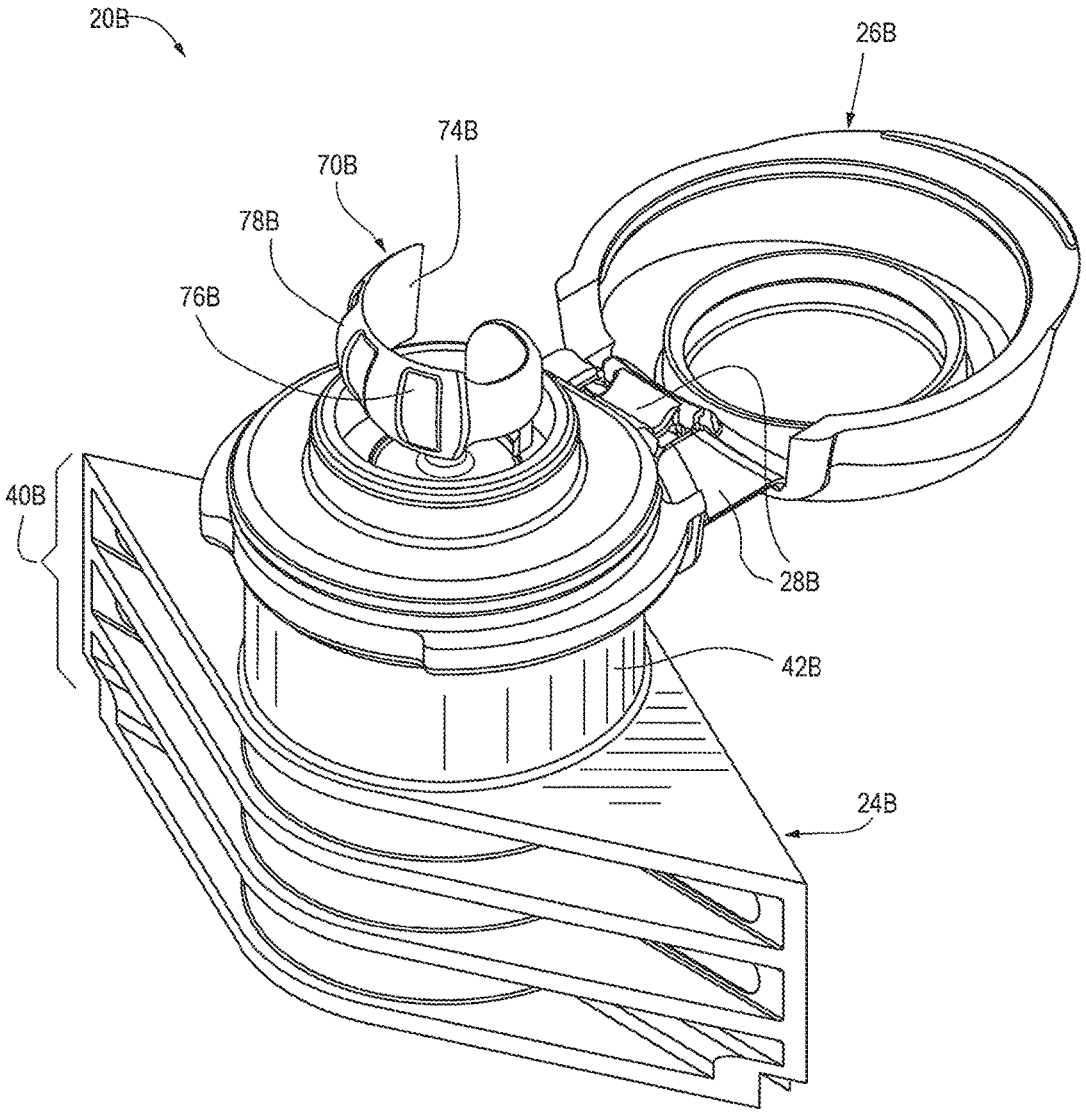
FIG. 14 is an isometric view of a third embodiment of a closure of the present invention shown with the lid open in the as-molded condition.
Figure 15:
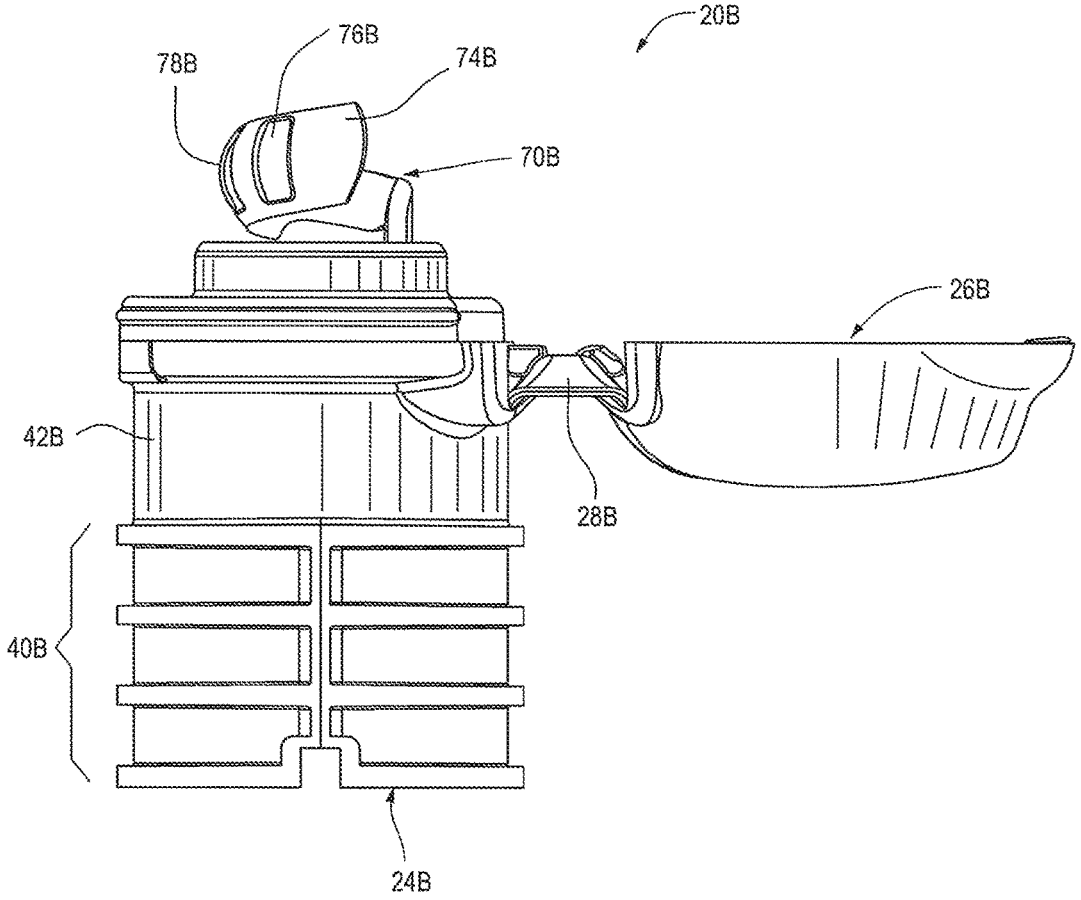
FIG. 15 is a side elevational view of the closure shown in FIG. 14.

With reference to FIGS. 14 and 16, the closure 20B has grippable portion 74B with the configuration of a partial helix, it will be appreciated that the grippable portion 74B may be provided in a variety of forms such as a partial helix with a different shape following the same path, a partial helix with a longer or shorter length, a partial helix with a greater or lesser pitch, or a partial helix of greater or lesser thickness than that shown in FIGS. 14 and 16.

The grippable portion 74B of the third embodiment of the closure 20B, which is in the form of a partial helix, has advantages such as, for example, contributing to a reduced stored height of the separation member 70B and reduced loading force on the separation member in the stored configuration. With a reduced stored height of the separation member 70B, the lid 26B may be provided with a decreased height, thus reducing material used in the closure 20B and reducing the overall size of the closure 20B.

Figure 17:
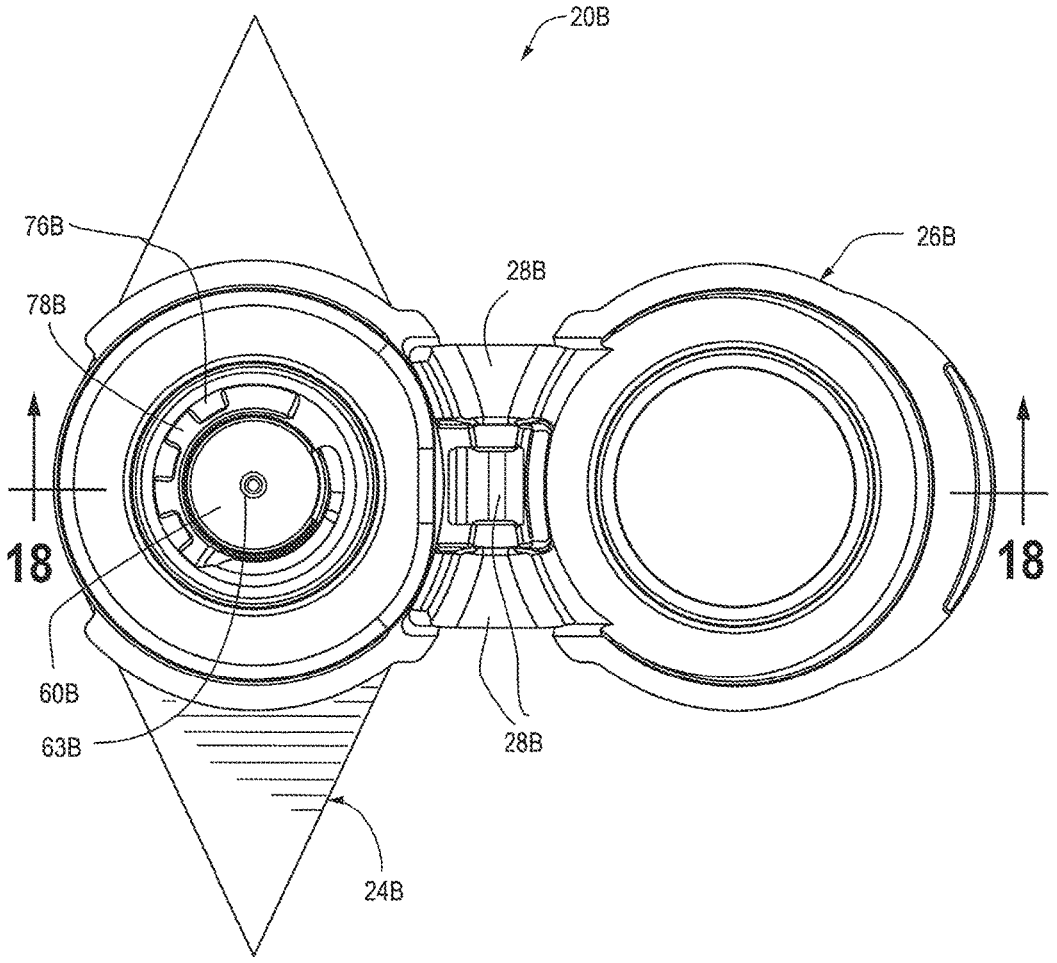
FIG. 17 is a top plan view of the closure shown in FIG. 14.
Figure 18:
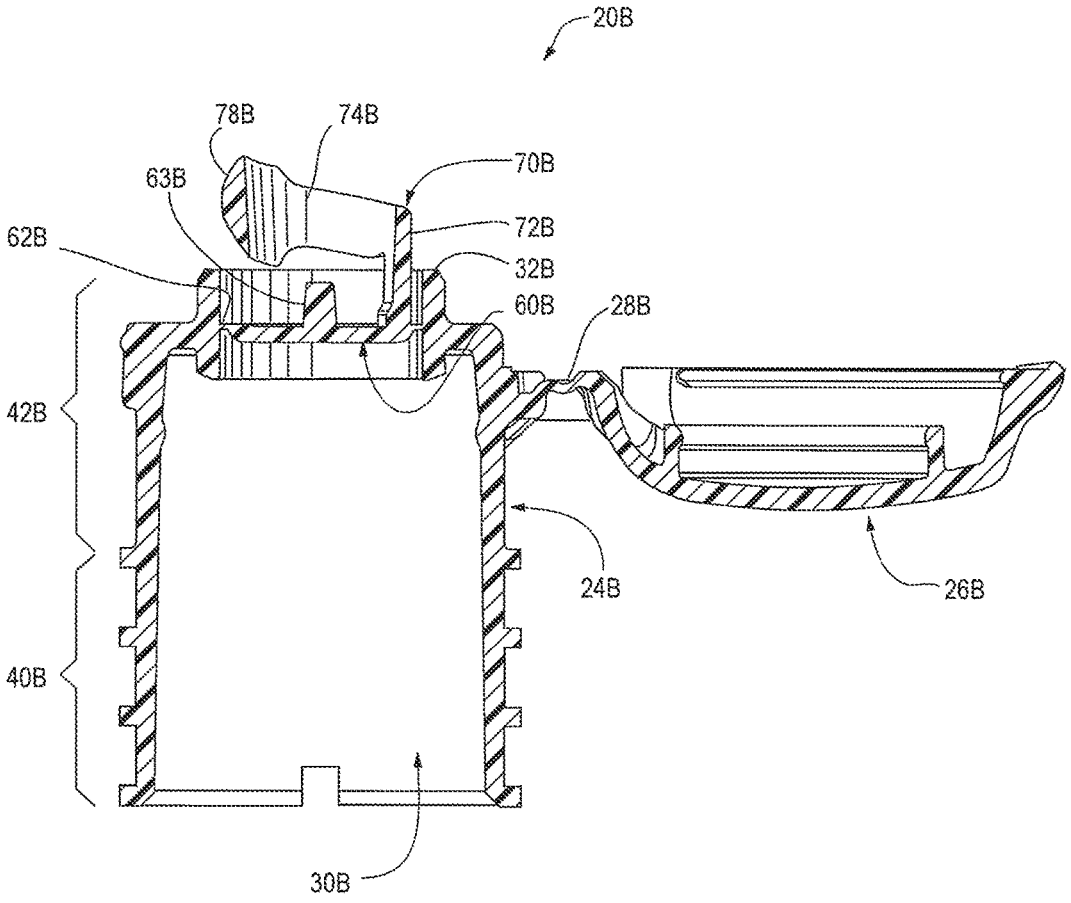
FIG. 18 is a cross-sectional view of the closure in FIG. 17 taken generally along the plane 18-18 in FIG. 17.

As best seen in FIGS. 16 and 17, the grippable portion 74B of the third embodiment may additionally have one or more recesses 76B to assist gripping by a user. While each recess 76B shown in the third illustrated embodiment has the form of a slot through the grippable portion 70B, it will be appreciated that each recess 76B may have a different geometry, such as an arcuate or polygonal slot, and may be provided with a varying depth. Although not illustrated, it will be appreciated that similar recesses may be provided on the grippable portion 74 of the first embodiment of the closure 20 described above with reference to FIGS. 1 and 3-13.

As best seen in FIGS. 16 and 17, the grippable portion 74B may additionally be provided with one or more protrusions 78B to assist gripping by a user. While each protrusion 78B shown in the illustrated third embodiment is in the form of a partial torus on the grippable portion 70B, it will be appreciated that each protrusion 78B may have different geometries, such as a raised polygon or molded texture, and may be provided with varying heights. It will further be appreciated that similar protrusions may be provided on the grippable portion 74 of the first embodiment of the closure 20.

The deployed height of the third embodiment of the separation member 70B (FIG. 18) above the body spout end 32B is less than the deployed height of the first embodiment separation member 70 (FIG. 12) above the body spout end 32. Yet, the third embodiment separation member 70B is still readily grippable by a user. The lower deployed height of the third embodiment separation member 70B can accommodate a lower height of the separation member 70B in the stored configuration when the lid 26B is closed (not illustrated). The reduced height of the separation member 70B in the stored configuration allows for a reduced height of the body 24B and a reduced height of the lid 26B. Thus, the outer end 32B of the body 24B (including any spout) may extend a shorter distance from the body 24B, and the through passage 30B may extend for a shorter distance through the body 24B. The configuration of the separation member 70B of the third embodiment of the closure 20B is such that the lid 26B imparts a force upon the separation member 70B when the separation member 70B is in the stored the stored configuration. The force imparted by the lid 26B upon the separation member 70B in the stored configuration may be less than the force imparted by the lid 26 upon the separation member 70 of the first embodiment of the closure 20.

It will also be appreciated that the closure 20, 20A, and 20B may be provided with a variety of dispensing passage configurations and/or structures.

It will be readily observed from the foregoing detailed description of the invention and from the illustrations thereof that numerous other variations and modifications may be effected without departing from the true spirit and scope of the novel concepts or principles of this invention.

What is claimed is:

1. A closure (20, 20A, 20B) that can selectively permit or prevent communication between the exterior and the interior of a system that has an opening between the exterior and interior, said closure (20, 20A, 20B) comprising:

(A) a closure body (24, 24A, 24B) that is either (a) a separate structure for being attached to said system at said opening, or (b) a structure formed as a unitary portion of said system at said opening, and wherein said body (24, 24A, 24B) has (1) an outer end (32, 32B) and a through passage (30, 30B) extending from said outer end (32, 32B) through said body (24, 24A, 24B); and (2) a membrane (60, 60B) that (a) initially occludes said passage (30, 30B), and (b) is initially connected to the rest of said body (24, 24A, 24B); and (B) a lid (26, 26B) to accommodate movement relative to said body (24, 24A, 24B) between (a) a closed position on said body (24, 24A, 24B) restricting access to said passage (30, 30B), and (b) an open position permitting at least greater access to said passage (30, 30B), wherein said body (24, 24A, 24B) further including a separation member (70, 70B) to be engaged by a user to separate at least a part of said membrane (60, 60B) from said body (24, 24A, 24B), said separation member (70, 70B) (1) extending from said membrane (60, 60B), (2) having a deployed configuration wherein said separation member (70, 70B) projects outwardly beyond said body outer end (32, 32B) when said lid (26, 26B) is in said open position, and (3) having the capability for assuming a stored configuration with said separation member (70, 70B) engaged by said lid (26, 26B) with said lid (26, 26B) in said closed position and wherein resiliency of said separation member (70, 70B) urges said separation member (70, 70B) from said stored configuration to said deployed configuration when said lid (26, 26B) is moved from said closed position to said open position, wherein said body (24, 24A, 24B) has the form of a generally boat-shaped fitment with a length (L) and a width (W), said length (L) being greater than said width (W), said lid (26, 26B) is connected to said body (24, 24A, 24B) by at least one connecting element (28, 28B), and wherein connection of said lid (26, 26B) with said body (24, 24A, 24B) orients said lid (26, 26B) to open only in a direction along said width (W) between said closed position and said open position of said lid (26, 26B).

2. The closure (20, 20A, 20B) in accordance with claim 1 for use with a system that includes a container (22, 22A) defining said opening, and wherein said body (24, 24A, 24B) is initially separate from, but non-releasably attachable to, said container (22, 22A) at said opening.

3. The closure (20, 20B) in accordance with claim 1 for use with a system that is a flexible pouch (22) defining said opening and wherein part of said body (24, 24B) is a fitment adapted for being sealingly secured to said flexible pouch (22) in said opening, said body (24, 24B) having a plurality of longitudinally-spaced ribs (99) for being sealed to said opening of said pouch (22).

4. The closure (20, 20A, 20B) in accordance with claim 1 in which said body (24, 24A, 24B) includes a base (40, 40B) and a spout (42, 42B) projecting outwardly from said base (40, 401); and said through passage (30, 30B) extends through both said base (40, 40B) and said spout (42, 42B).

5. The closure (20, 20A, 20B) in accordance with claim 4 in which said membrane (60, 60B) is located within said spout (42, 42B).

6. The closure (20, 20A, 20B) in accordance with claim 1 in which said lid (26, 26B), said membrane (60, 60B), and said body (24, 24A, 24B) are unitarily formed together.

7. The closure (20, 20A, 20B) in accordance with claim 1 in which said separation member (70, 70B) includes (1) a stem (72, 72B) extending outwardly from said membrane (60, 60B), and (2) a grippable portion (74, 74B) extending laterally from said stem (72, 72B).

8. The closure (20, 20A, 20B) in accordance with claim 7 in which said grippable portion (74, 74B) further has (1) at least one recess (76, 76B) to assist gripping by said user; and (2) at least one protrusion (78, 78B) to assist gripping by said user.

9. The closure (20, 20A) in accordance with claim 7 in which said grippable portion (74) has an arcuate configuration.

10. The closure (20A, 20B) in accordance with claim 7 in which said grippable portion (74B) has the configuration of a partial helix.

11. The closure (20, 20A, 20B) in accordance with claim 7 in which said stem (72, 72B) has an increased thickness at said membrane (60, 60B).

12. The closure (20, 20A, 20B) in accordance with claim 1 in which said body (24, 24A, 24B) further has an alignment feature (52, 52B) for aligning said body (24, 24A, 24B) relative to said system during installation on said system, wherein said alignment feature (52, 52B) has the form of a rectangular slot extending through said body (24, 24A, 24B) along said length (L).

13. The closure (20, 20A, 20B) in accordance with claim 1 in which said membrane (60, 60B) includes a laterally outward peripheral portion (62, 62B) connected with said closure body (24, 24A, 24B).

14. The closure (20, 20A, 20B) in accordance with claim 13 in which said peripheral portion (62, 62B) is a reduced cross section weakened area of said membrane (60, 60B).

15. The closure (20, 20A, 20B) in accordance with claim 1 wherein said stored configuration is an elastically deformed configuration.

16. The closure (20, 20A, 20B) in accordance with claim 1 in which said membrane (60, 60B) includes an injection boss (63, 63B) extending outwardly from said membrane (60, 60B).

17. The closure (20, 20A) in accordance with claim 9 in which said grippable portion (74) extends in said arcuate configuration through a central angle of less than, or equal to, 180 degrees.

18. The closure (20, 20A) in accordance with claim 1 in which each of said lid (26, 26A, 26B) and said body (24, 24A, 24B) include mating latch features (100) for retaining said lid (26, 26A, 26B) in said closed position.

19. The closure (20, 20A) in accordance with claim 7 in which said grippable portion (74, 74B) is located only on one side of said length (L) of said body (24, 24A, 24B).

20. A closure (20, 20A) that can selectively permit or prevent communication between the exterior and the interior of a system that has an opening between the exterior and interior, said closure (20, 20A) comprising:

(A) a closure body (24, 24A) that is either (a) a separate structure for being attached to said system at said opening, or (b) a structure formed as a unitary portion of said system at said opening, and wherein said body (24, 24A) has (1) an outer end (32) and a through passage (30) extending from said outer end (32) through said body (24, 24A); and (2) a membrane (60) that (a) initially occludes said passage (30), and (b) is initially connected to the rest of said body (24, 24A); and (B) a lid (26) to accommodate movement relative to said body (24, 24A) between (a) a closed position on said body (24, 24A) restricting access to said passage (30), and (b) an open position permitting at least greater access to said passage (30), wherein said body (24, 24A) further including a separation member (70) to be engaged by a user to separate at least a part of said membrane (60) from said body (24, 24A), said separation member (70) (1) extending from said membrane (60), (2) having a deployed configuration wherein said separation member (70) projects outwardly beyond said body outer end (32) when said lid (26) is in said open position, and (3) having the capability for assuming a stored configuration with said separation member (70) engaged by said lid (26) with said lid (26) in said closed position and wherein resiliency of said separation member (70) urges said separation member (70) from said stored configuration to said deployed configuration when said lid (26) is moved from said closed position to said open position, wherein said separation member (70) includes (1) a stem (72) extending outwardly from said membrane (60), and (2) a grippable portion (74, 74B) extending laterally from said stem (72), and wherein only said stem (72) is engaged by said lid (26) with said separation member (70) in said stored configuration.

* * * * *